US012527405B2

(12) United States Patent
Shen

(10) Patent No.: US 12,527,405 B2
(45) Date of Patent: Jan. 20, 2026

(54) FOLDING COUCH

(71) Applicant: Huzhou Suoten Import & Export Co., Ltd., Huzhou (CN)

(72) Inventor: Wenjie Shen, Ningbo (CN)

(73) Assignee: Huzhou Suoten Import & Export Co., Ltd., Huzhou (CN)

( * ) Notice: Subject to any disclaimer, the term of this patent is extended or adjusted under 35 U.S.C. 154(b) by 142 days.

(21) Appl. No.: 18/507,608

(22) Filed: Nov. 13, 2023

(65) Prior Publication Data

US 2025/0143474 A1 May 8, 2025

(30) Foreign Application Priority Data

Nov. 6, 2023 (CN) ..... 202322985846.2

(51) Int. Cl.
*A47C 17/16* (2006.01)
*A47C 17/86* (2006.01)

(52) U.S. Cl.
CPC ..... *A47C 17/163* (2013.01); *A47C 17/86* (2013.01)

(58) Field of Classification Search
CPC ..... A47C 17/163; A47C 17/86; A47C 19/122
USPC ..... 5/12.1
See application file for complete search history.

(56) References Cited

U.S. PATENT DOCUMENTS 336,110 A * 2/1886 Hemingway ..... A47C 19/122 5/111
2,121,100 A * 6/1938 Rosenbaum ..... A47C 17/17 297/244
2,772,423 A * 12/1956 Linden ..... A47D 9/005 5/98.1
3,661,421 A * 5/1972 Johnson ..... A47C 1/03 297/411.39
3,886,606 A * 6/1975 Bradford ..... A61G 1/013 5/628
4,179,763 A * 12/1979 Echavarren ..... A47C 19/205 5/8
4,717,201 A * 1/1988 Barras ..... A47C 4/38 297/16.2
4,922,561 A * 5/1990 Williams ..... A47C 17/32 297/62
5,217,315 A * 6/1993 Rosane ..... F16C 11/10 403/100
6,109,685 A * 8/2000 Lindsey ..... A47C 7/546 297/411.39
6,234,571 B1 * 5/2001 Atkins ..... A47C 3/04 297/239

(Continued)

FOREIGN PATENT DOCUMENTS

CN 211269581 U 8/2020
CN 211984673 U * 11/2020 ..... A47C 17/16
CN 214433144 U 10/2021

*Primary Examiner* — Justin C Mikowski
*Assistant Examiner* — Luke Hall
(74) *Attorney, Agent, or Firm* — Nitin Kaushik

(57) ABSTRACT

The folding couch including: a first bed frame, a second bed frame, a first support assembly and a second support assembly, wherein the first bed frame and the second bed frame are hinged via a hinge, the first support assembly is used for supporting the first bed frame, and the second support assembly is used for supporting the second bed frame. The first support assembly and the second support assembly are foldable and stowable to the first bed frame and the second bed frame.

8 Claims, 8 Drawing Sheets

(56) References Cited

U.S. PATENT DOCUMENTS

| | | | | |
|---|---|---|---|---|
| 2012/0038122 | A1* | 2/2012 | Canova | A47C 9/027<br>280/32.6 |
| 2013/0082455 | A1* | 4/2013 | Chen | A47D 1/002<br>297/16.1 |
| 2024/0156252 | A1* | 5/2024 | Cass | B60N 3/103 |

* cited by examiner

FOLDING COUCH

CROSS-REFERENCE TO RELATED APPLICATIONS

The application claims priority to Chinese patent application No. 2023229858462, filed on Nov. 6, 2023, the entire contents of which are incorporated herein by reference.

TECHNICAL FIELD

The present invention relates to the field of folding beds and more particularly to a folding couch.

BACKGROUND

The couch is widely used in leisure, entertainment, travel, etc. and have gradually become a fashion where people can feel more comfortable and enjoy the natural breath so that the body is fully relaxed.

In the prior art, with the popularity of online shopping, the requirements for the outer package size of products are higher and higher, a large package makes transportation difficult and the transportation cost high. Therefore, people urgently want the products packaged to be small, in general, the couches are packaged to be large, so a folding couch will naturally become the first choice. Any part of the folding couch body can be folded up, it is like a large leather suitcase after being packaged, and after packaging with special packaging bags, it can be easily placed in any corner, which is a good choice for domestic use or tourism.

Therefore, how to provide a folding couch so as to fold and store the couch becomes a technical problem to be urgently solved.

SUMMARY

A technical problem to be solved by the present invention is how to provide a folding couch so as to facilitate folding and stowing the couch.

To this end, according to a first aspect, an embodiment of the invention discloses a folding couch including: a first bed frame, a second bed frame, a first support assembly and a second support assembly, wherein the first bed frame and the second bed frame are hinged via a hinge, the first support assembly is used for supporting the first bed frame, and the second support assembly is used for supporting the second bed frame, and the first support assembly includes a first support rod, a first support frame and a first locking sliding sleeve, one end of the first support rod is hinged to the first bed frame, the other end of the first support rod is hinged to the first support frame, the first locking sliding sleeve is used for locking the first support rod and the first support frame on the same support surface, the second support assembly includes a second support rod, a second support frame and a second locking sliding sleeve, one end of the second support rod is hinged to the second bed frame, the other end of the second support rod is hinged to the second support frame, and the second locking sliding sleeve is used for locking the second support rod and the second support frame on the same support surface.

The present invention further provides that a first telescopic link is hinged with the first bed frame and is hinged to the first support rod.

The present invention further provides that the second bed frame is hinged with a second telescopic link, and the second telescopic link is hinged to the second support rod.

The present invention further provides that the first bed frame is hinged with a back rest which is hinged with a support buckle, and the first bed frame is provided with a cross bar clamped with the support buckle.

The present invention further provides that the support buckle is provided with a number of slots, and the cross bar is clamped with the slots.

The present invention further provides that the slot is arranged in a cambered surface.

The invention further provides that the first bed frame is provided with a detachably connected table board.

The invention further provides that the table board is provided with counterbores.

The present invention has the following advantageous effects: since the first bed frame and the second bed frame are hinged via a hinge, the first support assembly supports the first bed frame, and the second support assembly supports the second bed frame, thereby providing a folding couch, and the first support assembly and the second support assembly are foldable and stowable, facilitating the folding and stowing of the couch, and the transportation thereof, and reducing transportation costs.

BRIEF DESCRIPTION OF DRAWINGS

In order to more clearly illustrate the embodiments of the present invention or the technical solutions in the prior art, the drawings used in the embodiments or the prior art descriptions will be briefly described below, and it is obvious that the drawings in the following description are some embodiments of the present invention, and other drawings can be obtained by a person skilled in the art without creative efforts.

REFERENCE NUMERALS

Figure 1:
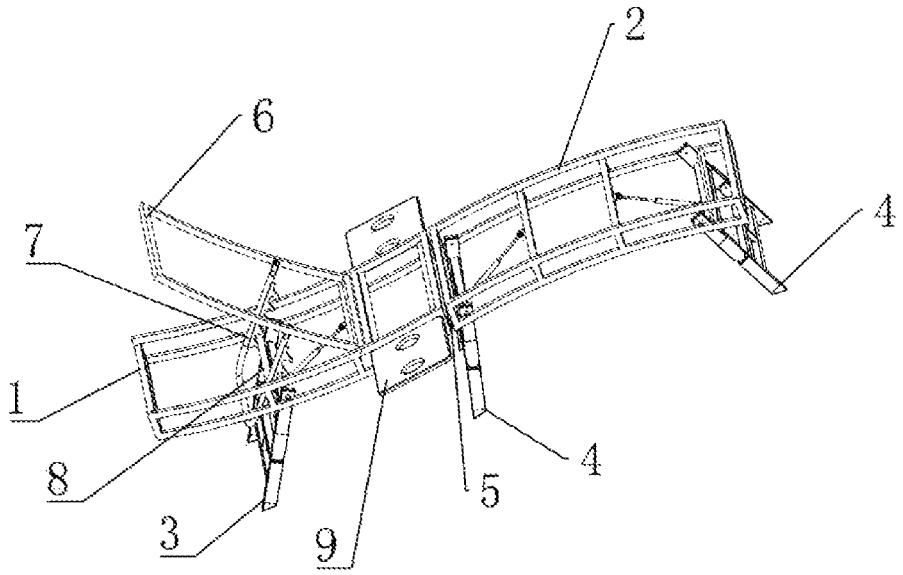
FIG. 1 is a schematic perspective view of a folding couch according to the present embodiment.
Figure 2:
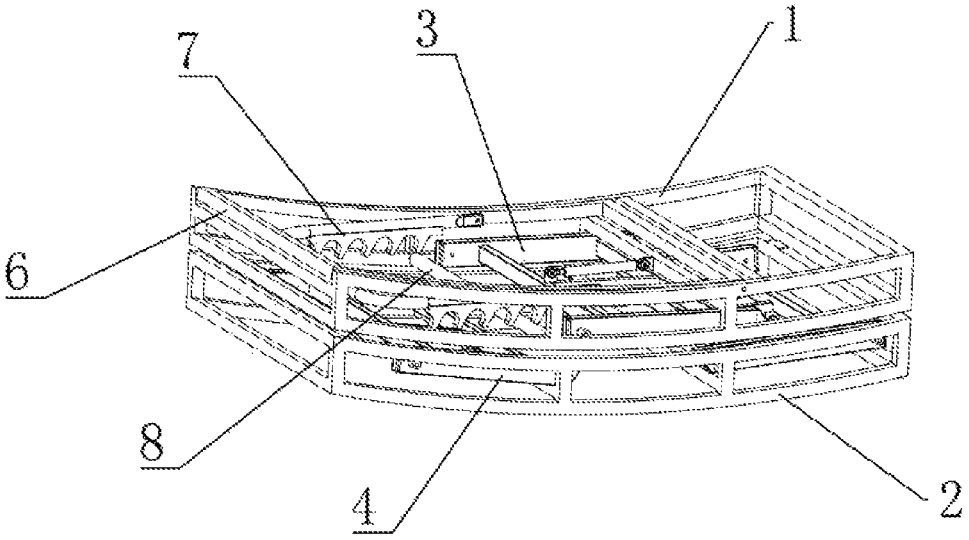
FIG. 2 is a schematic diagram showing a storage structure of a folding couch according to the present embodiment.
Figure 3:
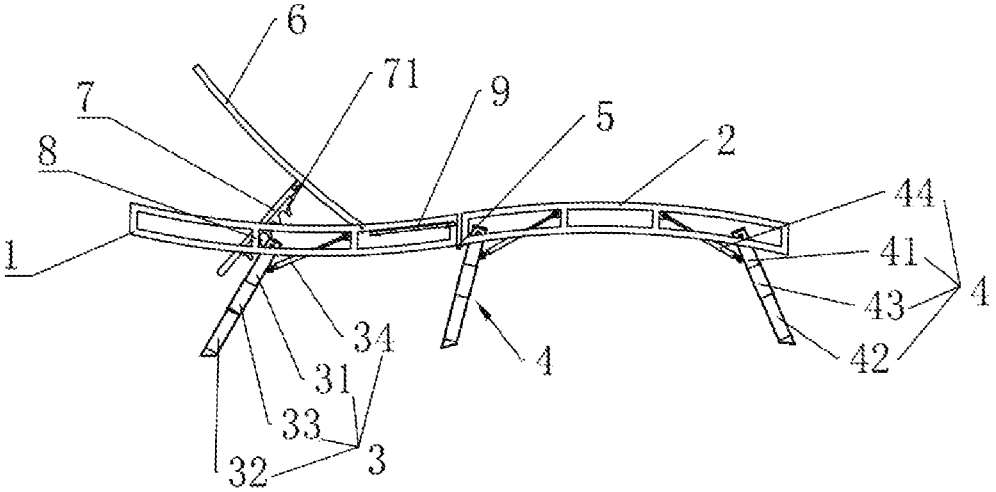
FIG. 3 is a schematic side view of a folding couch according to the present disclosure.
Figure 4:
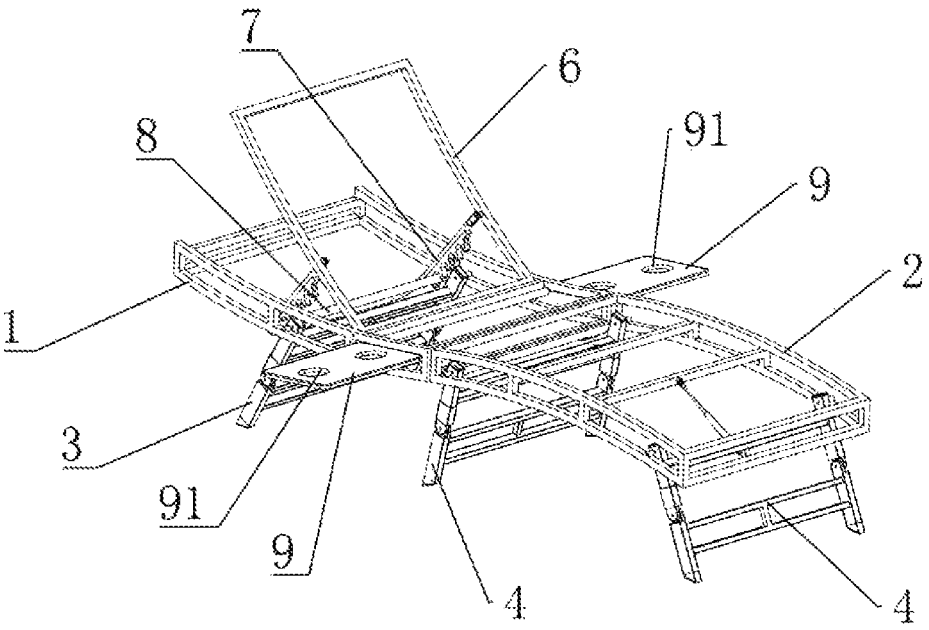
FIG. 4 is a schematic diagram showing an unfolded structure of a folding couch according to the present embodiment.

1. first bed frame; 2. second bed frame; 3. first support assembly; 31. first support rod; 32. first support frame; 33. first locking sliding sleeve; 34. first telescopic link; 4. second support assembly; 41. second support rod; 42. second support frame; 43. second locking sliding sleeve; 44. second telescopic link; 5. hinge; 6. back rest; 7. support buckle; 71. slot; 8. cross bar; 9. table board; 91. counterbore.

DETAILED DESCRIPTION OF THE EMBODIMENTS

In order that the objects, aspects and advantages of the present invention will become more apparent, a more particular description of the present invention will be rendered by reference to the embodiments thereof which are illustrated in the appended drawings. It should be understood that the particular embodiments described herein are illustrative only and are not limiting.

In the description of the present invention, it should be noted that, unless expressly specified or limited otherwise, the terms "mounted", "connected to", and "connected" are to be interpreted broadly, e.g. either fixedly or detachably, or integrally; may be a mechanical connection or an electrical connection; it can be directly connected or indirectly connected through an intermediate medium, can be the communication between two elements, and can be a wireless connection or a wired connection. The specific meaning of the above terms in the present invention can be understood in detail by a person skilled in the art.

In describing the present invention, it should be noted that the terms "central", "upper", "lower", "left", "right", "vertical", "horizontal", "inner", "outer", and the like designate orientations or positional relationships based on the orientation or positional relationships shown in the drawings, are merely for convenience in describing the invention and to simplify the description, and do not indicate or imply that the referenced devices or elements must have a particular orientation, be constructed and operated in a particular orientation, and thus should not be construed as limiting the invention. Further, the terms "first", "second", and "third" are used for descriptive purposes only and are not to be construed as indicating or implying relative importance.

Further, the technical features involved in the different embodiments of the present invention described below can be combined with each other as long as they do not conflict with each other.

An embodiment of the present invention discloses a folding couch, as shown in FIGS. 1-8, which includes: a first bed frame 1, a second bed frame 2, a first support assembly 3 and a second support assembly 4, wherein the first bed frame 1 and the second bed frame 2 are hinged via a hinge 5, the first support assembly 3 is used for supporting the first bed frame 1, and the second support assembly 4 is used for supporting the second bed frame 2, and the first support assembly 3 includes a first support rod 31, a first support frame 32 and a first locking sliding sleeve 33, one end of the first support rod 31 is hinged to the first bed frame 1, the other end of the first support rod 31 is hinged to the first support frame 32, the first locking sliding sleeve 33 is used for locking the first support rod 31 and the first support frame 32 on the same support surface, the second support assembly 4 includes a second support rod 41, a second support frame 42 and a second locking sliding sleeve 43, one end of the second support rod 41 is hinged to the second bed frame 2, the other end of the second support rod 41 is hinged to the second support frame 42, and the second locking sliding sleeve 43 is used for locking the second support rod 41 and the second support frame 42 on the same support surface. In practice, the number of the first support assemblies 3 and the second support assemblies 4 is unlimited, and the number of the second support assemblies 4 may be two.

It should be noted that since the first bed frame 1 and the second bed frame 2 are hinged via the hinge 5, the first support assembly 3 supports the first bed frame 1, and the second support assembly 4 supports the second bed frame 2, thereby providing a folding couch, the first support assembly 3 and the second support assembly 4 are foldable and stowable, facilitating the folding and stowing of the couch, reducing the volume of the couch, facilitating the transportation thereof, and reducing the transportation cost.

Figure 5:
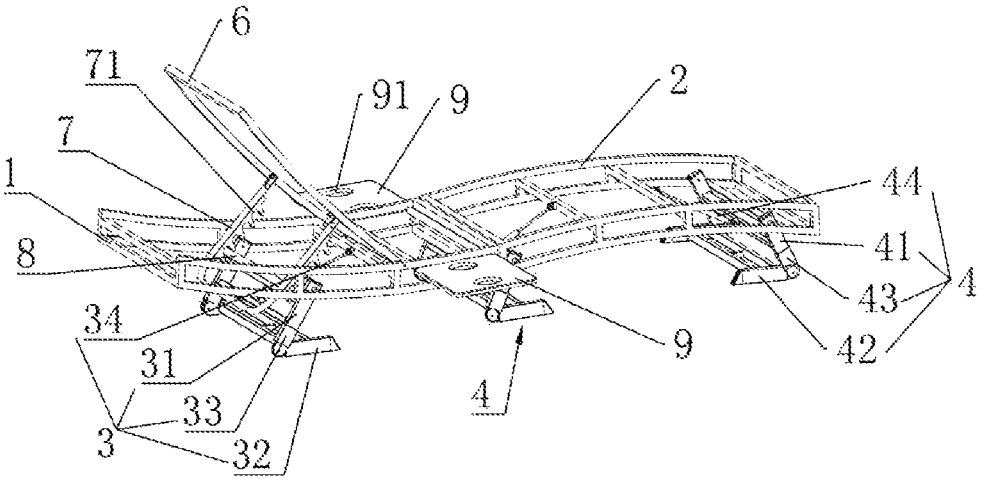
FIG. 5 is a schematic diagram showing a use state of a folding couch according to the present embodiment.
Figure 6:
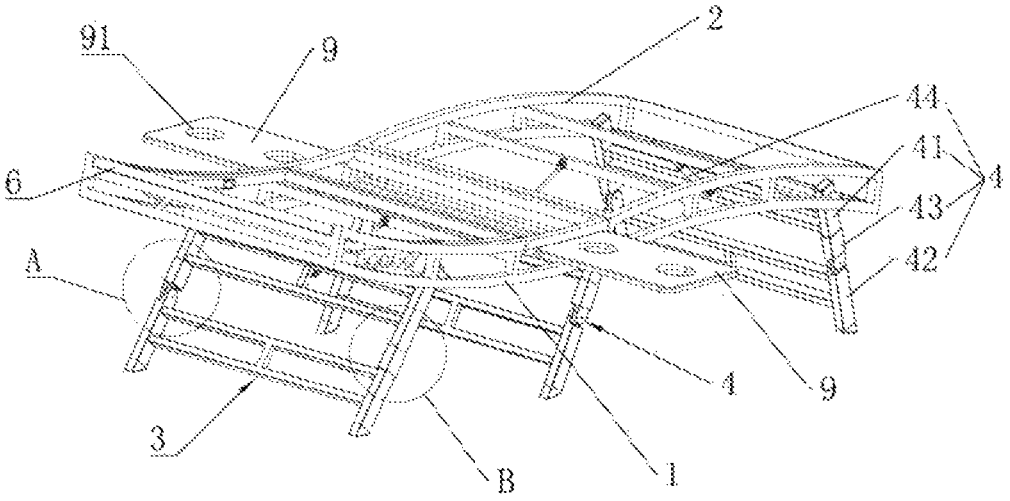
FIG. 6 is a schematic diagram showing an open structure of a folding couch according to the present embodiment.
Figure 7:
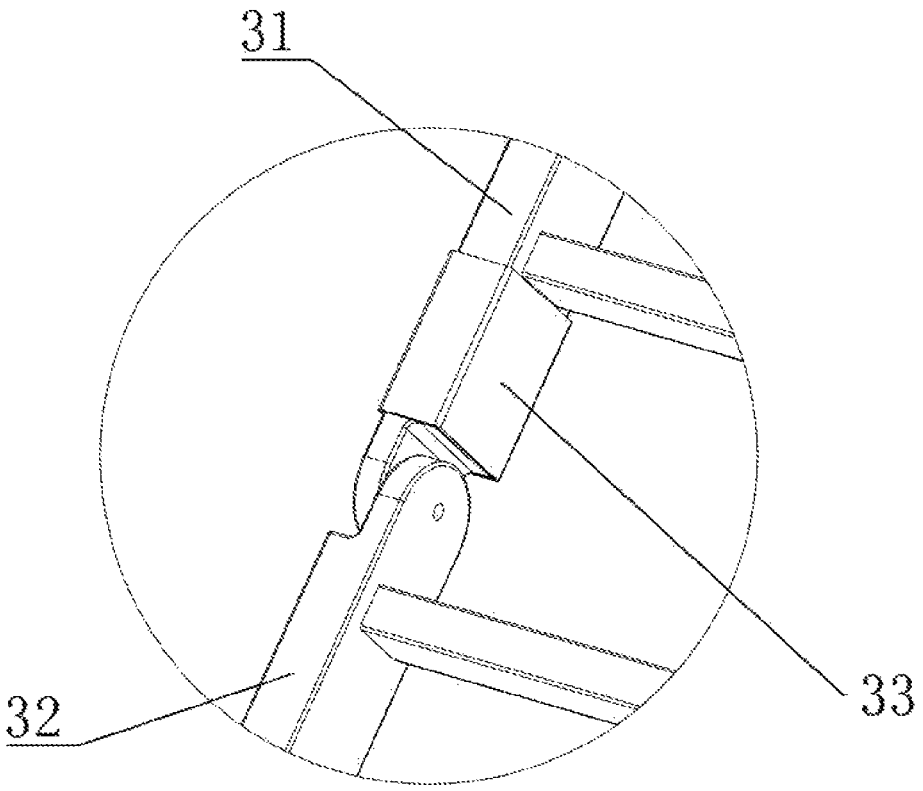
FIG. 7 is an enlarged structural view at A of FIG. 6.
Figure 8:
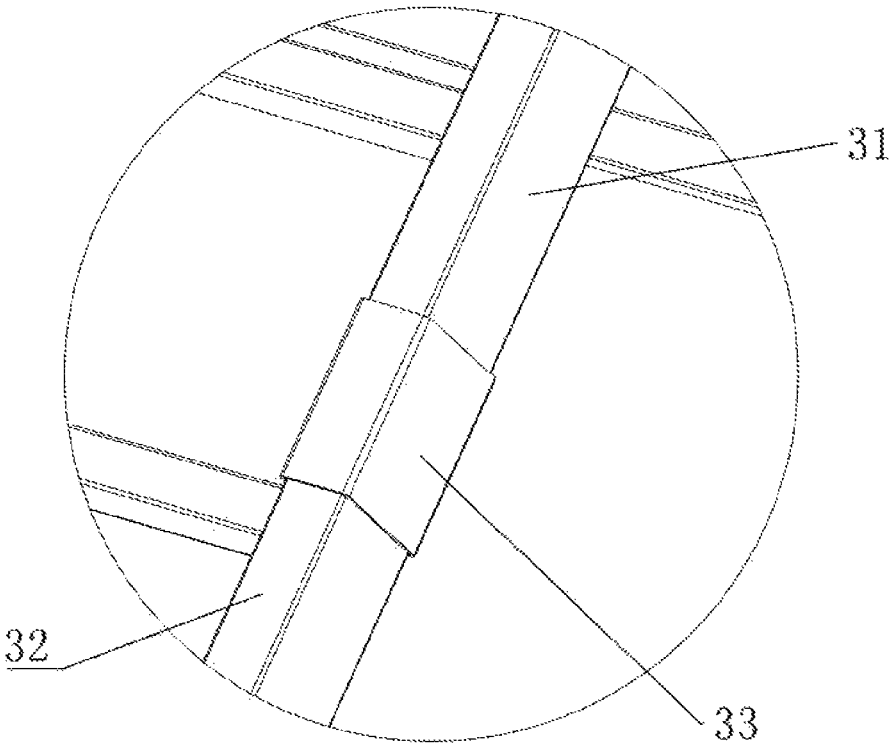
FIG. 8 is an enlarged structural view at B of FIG. 6.

As shown in FIG. 5, it should also be stated that the first support rod 31 and the first support frame 32 are locked on the same support surface and the second support rod 41 and the second support frame 42 are locked on the same support surface by the locking action of the first locking sliding sleeve 33 and the second locking sliding sleeve 43, so as to facilitate the support of the first bed frame 1 and the second bed frame 2, and the first bed frame 1 and the second bed frame 2 are ergonomically designed to improve the comfort of the couch, thereby facilitating the user to lie at rest. In addition, by sliding out the first locking sliding sleeve 33 and the second locking sliding sleeve 43 so that the first support rod 31 and the second support rod 41 are supported on the ground, and the first support frame 32 and the second support frame 42 are horizontally placed on the ground, the height of the couch is reduced, the use state of the couch is enriched, and the user's use experience is further enhanced.

As shown in FIGS. 3-8, a first telescopic link 34 is hinged to the first bed frame 1 and is hinged to the first support rod 31. It is to be noted that when the folding couch is unfolded, the first telescopic link 34 is in an extended state, and the first bed frame 1 is effectively supported by the first support rod 31 and the first telescopic link 34; when the folding couch is stowable, the first telescopic link 34 is contracted to facilitate stowing the first support assembly 3 in the first bed frame 1.

As shown in FIGS. 3-8, a second telescopic link 44 is hinged to the second bed frame 2, and the second telescopic link 44 is hinged to the second support rod 41. When the folding couch is unfolded, the second telescopic link 44 is in an extended state, and the second bed frame 2 is effectively supported by the second support rod 41 and the second telescopic link 44; however, when the folded bed is stowed, the second telescopic link 44 is retracted to facilitate stowing the second support assembly 4 into the second bed frame 2.

As shown in FIGS. 1-6, the first bed frame 1 is hinged with a back rest 6, the back rest 6 is hinged with a support buckle 7, and the first bed frame 1 is provided with a cross bar 8 clamped with the support buckle 7. It should be noted that the support function of the support buckle 7 facilitates the support of the back rest 6 and the direct leaning of the user: when the support buckle 7 is lifted, the support buckle 7 is disengaged from the cross bar 8, and then both the support buckle 7 and the back rest 6 are stowable in the first bed frame 1, and the support buckle 7 and the back rest 6 are folded and placed in a horizontal state.

As shown in FIGS. 1-6, a number of clamping grooves 71 distributed in a straight line are provided on the support buckle 7, and the cross bar 8 is clamped with the clamping grooves 71. It should be noted that since the cross bar 8 is clamped with the clamping groove 71, when the cross bar 8 is placed in different clamping grooves 71, the inclination angle of the back rest 6 can be adjusted so as to adapt to different leaning angles of the user and enhance the user's experience.

As shown in FIGS. 1-6, the clamping groove 71 is arranged in a cambered surface. It should be noted that since the snap groove 71 is arranged in a cambered surface, and the support buckle 7 and the cross bar 8 are easily clamped.

As shown in FIGS. 1-6, the first bed frame 1 is provided with a detachably connected table board 9. In the specific implementation, two table boards 9 are provided and are distributed on two opposite sides of the first bed frame 1: by providing the table board 9, it is convenient for the user to place articles such as cups, mobile phones, snacks, etc.

As shown in FIGS. 1-6, the table board 9 is provided with counterbores 91. It should be noted that the counterbores 91 are provided to place a cup.

Working principle: since the first bed frame 1 and the second bed frame 2 are hinged via a hinge 5, the first support assembly 3 supports the first bed frame 1, and the second support assembly 4 supports the second bed frame 2, thereby providing a folding couch, and the first support assembly 3 and the second support assembly 4 are foldable and stowable, facilitating the folding and stowing of the couch and the transportation thereof, which may reduce transportation costs.

It is to be understood that the above-described embodiments are merely illustrative for clarity and are not restrictive of the embodiments. It will be apparent to a person skilled in the art that various other modifications and variations can be made in the present invention without departing from the scope or spirit of the invention. All embodiments need not be, and cannot be, exhaustive. Obvious modifications or variations are possible in light of the above teachings.

What is claimed is:

1. A folding couch, comprising: a first bed frame (1), a second bed frame (2), a first support assembly (3) and a second support assembly (4), wherein the first bed frame (1) and the second bed frame (2) are hinged via a hinge (5), the first support assembly (3) is used for supporting the first bed frame (1), and the second support assembly (4) is used for supporting the second bed frame (2), and the first support assembly (3) comprises a first support rod (31), a first support frame (32) and a first locking sliding sleeve (33), one end of the first support rod (31) is hinged to the first bed frame (1), the other end of the first support rod (31) is hinged to the first support frame (32), the first locking sliding sleeve (33) is used for locking the first support rod (31) and the first support frame (32) on the same support surface, the second support assembly (4) comprises a second support rod (41), a second support frame (42) and a second locking sliding sleeve (43), one end of the second support rod (41) is hinged to the second bed frame (2), the other end of the second support rod (41) is hinged to the second support frame (42), and the second locking sliding sleeve (43) is used for locking the second support rod (41) and the second support frame (42) on the same support surface;

the first bed frame (1) and the second bed frame (2) form a double-layered structure with a hollow space for accommodating the first support assembly (3) and the second support assembly (4); the first support assembly (3) and the second support assembly (4) are folded and stored within the hollow space of the first bed frame (1) and the second bed frame (2), with the folding direction of the first support assembly (3) being opposite to that of the second support assembly (4).

2. The folding couch according to claim 1, wherein a first telescopic link (34) is hinged with the first bed frame (1) and is hinged to the first support rod (31).

3. The folding couch according to claim 1, wherein the second bed frame (2) is hinged with a second telescopic link (44), and the second telescopic link (44) is hinged to the second support rod (41).

4. The folding couch according to claim 1, wherein the first bed frame (1) is hinged with a back rest (6), the back rest (6) is hinged with a support buckle (7), and the first bed frame (1) is provided with a cross bar (8) clamped with the support buckle (7).

5. The folding couch according to claim 4, wherein the support buckle (7) is provided with a number of slots (71), and the cross bar (8) is clamped with the slots (71).

6. The folding couch according to claim 5, wherein the slots (71) are arranged in a cambered surface.

7. The folding couch according to claim 1, wherein the first bed frame (1) is provided with a detachably connected table board (9).

8. The folding couch according to claim 7, wherein the table board (9) is provided with counterbores (91).

* * * * *